US005403229A

United States Patent [19]

Seli

[11] Patent Number: 5,403,229

[45] Date of Patent: Apr. 4, 1995

[54] FOOT PAD EXTENDER FOR A BELT SANDER

[76] Inventor: John Seli, 2150 Randolph Rd., Mogadore, Ohio 44260

[21] Appl. No.: 832,083

[22] Filed: Feb. 6, 1992

[51] Int. Cl.[6] ..... B24B 23/06

[52] U.S. Cl. ..... 451/350; 451/352; 451/355

[58] Field of Search ..... 51/148, 170 EB, 174, 51/180, 176

[56] References Cited

U.S. PATENT DOCUMENTS 1,804,523 5/1931 Wolfe et al. ..... 51/174
1,913,503 6/1933 Myers ..... 51/174
1,921,513 8/1933 Emmons ..... 51/174

*Primary Examiner*—Bruce M. Kisliuk
*Assistant Examiner*—Eileen Morgan
*Attorney, Agent, or Firm*—David M. Lowry

[57] ABSTRACT

A belt sander is constructed of a housing with a base, cylindrical drums disposed parallel to each other at opposite ends of the base and a foot pad positioned between the cylindrical drums whereby the area of the sanding surface of a sanding belt bearing against the foot pad during rotation of the sanding belt defines a sanding footprint. The improvement comprises a structural element secured to the foot pad for extending the sanding foot print beyond the housing.

17 Claims, 4 Drawing Sheets

FOOT PAD EXTENDER FOR A BELT SANDER

This invention relates generally to belt sanders and more particularly to an improvement in belt sanders for sanding beyond the housing of the sander.

BACKGROUND OF THE INVENTION

Belt sanders are particularly useful for rapidly sanding flat surfaces, such as floors. However, the prior art belt sanders were not able to sand up to the very edge of a transverse surface intersecting the surface being sanded. For instance, when sanding a floor in a room, the edge of the floor adjacent to a wall or corner cannot be sanded with a belt sander because the sander housing interferes and prevents the sanding belt from contacting the floor surfaces adjacent to the wall.

The present invention is directed to overcoming this limitation and deficiency in the prior art belt sanding devices.

SUMMARY OF THE INVENTION

The present invention is generally directed to a foot pad adapted for attachment to a housing of a belt sander including a flat plate secured to the foot pad for extending the sanding foot print of the belt sander beyond the housing.

In accordance with the invention, the belt sander has a housing with a base, first and second cylindrical drums disposed parallel to each other at opposite ends of the base and a foot pad positioned between the cylindrical drums whereby the area of the sanding surface of a sanding belt bearing against the foot pad during rotation of the sanding belt defines a sanding footprint. A foot pad extender is attached to the foot pad for extending the sanding footprint beyond the housing.

Further in accordance with the invention, the foot pad extender comprises a flat plate having a first end attached to the foot pad and a second end projecting beyond an end of the housing. The second end comprises a bearing surface over which the inner surface of the sanding belt rides. The bearing surface is a rounded or dulled edge which extends substantially parallel to the first and second cylindrical drums.

Also in accordance with the invention, the flat plate and the foot pad are a rectangular, unitary structure. The foot pad has two upright shoulders extending transversely across opposing ends of the pad for securing the pad to the housing.

In accordance with the invention, the modified foot pad with extender is inexpensive to manufacture in that the pad and extender can be easily welded together. Since the structural shape of the prior art foot pad remains intact, the improved pad with extender can be easily installed without any modification to the belt sander.

It is a principal object of the present invention to provide an improved belt sander without the problems and deficiencies of the prior art belt sanders.

It is another object of the present invention to provide a belt sander having a foot pad extender for extending the sanding footprint beyond the housing.

It is yet another object of the invention to provide a foot pad with a foot pad extender which is relatively inexpensive to manufacture and easy to install onto a conventional belt sander.

These and other objects and advantages of the present invention will become apparent from the following description taken in conjunction with the accompanying drawings which are described below.

BRIEF DESCRIPTION OF THE DRAWINGS

The invention can take physical form in certain parts and arrangement of parts, preferred embodiments of which will be described in detail and illustrated in the accompanying drawings which form a part hereof and wherein.

DETAILED DESCRIPTION OF THE INVENTION

Figure 1:
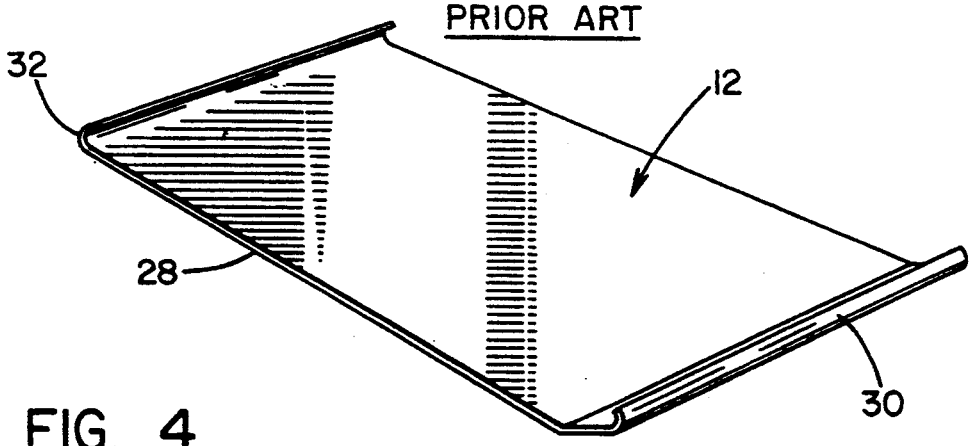
FIG. 1 PRIOR ART
FIG. 1 is a perspective, front elevation view of a prior art foot pad.
Figure 2:
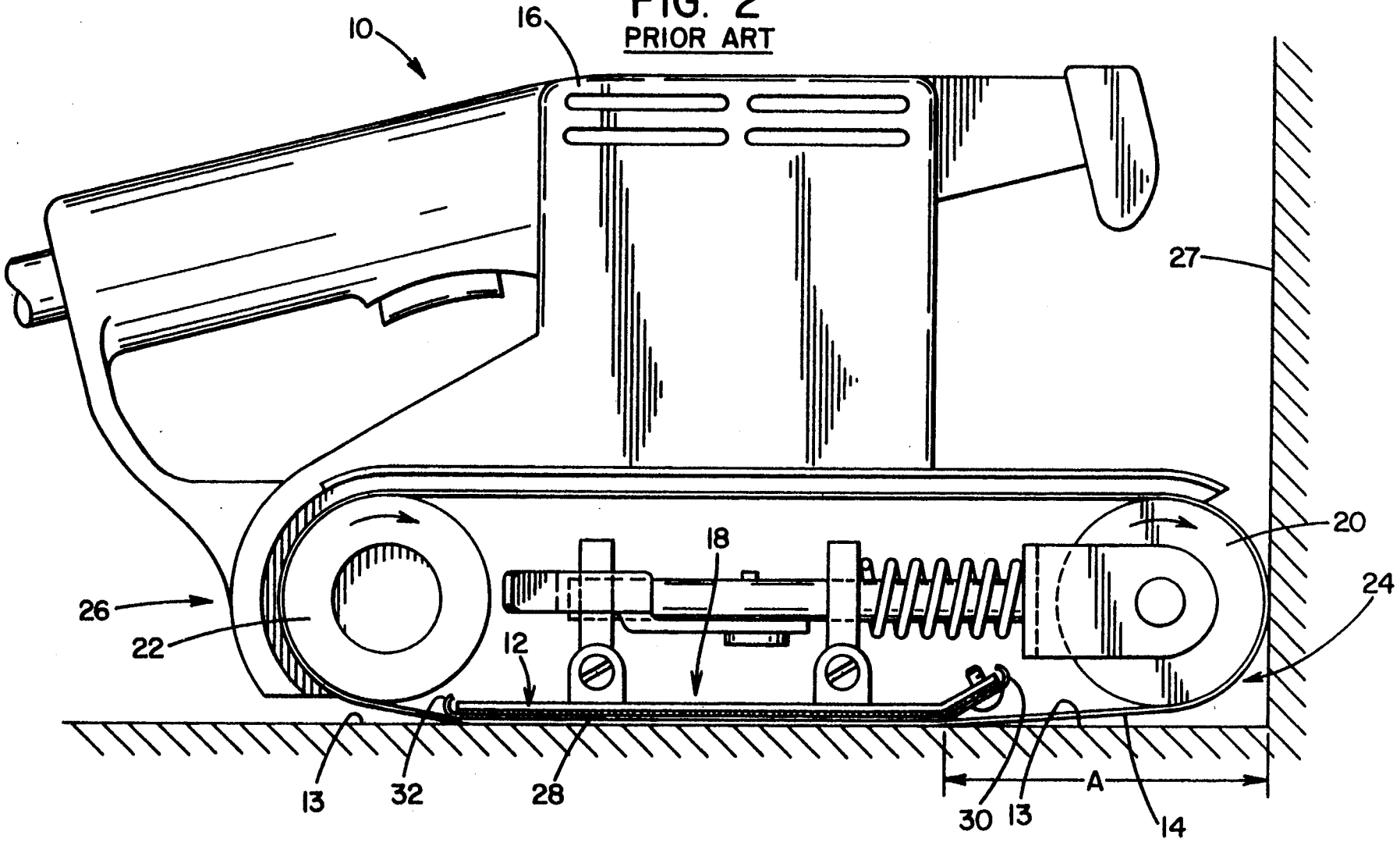
FIG. 2 PRIOR ART
FIG. 2 is a side view of a prior art belt sander abutted against a vertical surface.

Referring now to the drawings wherein the showings are for the purpose of illustrating the preferred embodiments of the invention only and not for the purpose of limiting same, FIGS. 1 and 2 illustrate a prior art belt sanding machine 10 (herein called a "sander") and foot pad 12 suitable for sanding flat surfaces such as a floor 13.

The general structure of the belt sander 10 and the mounting elements for attaching a sanding belt 14 are set forth. Sander 10 usually comprises a housing 16 with a base 18 and first and second cylindrical drums 20 and 22 disposed at first and second opposite ends 24 and 26, respectively, of the base 18. Typically, the first drum 20 at the front of the sander freely rotates and is movable between first and second positions to loosen or increase the tension on the sanding belt. That is, when a sanding belt is installed, a belt tension release lever, not shown, moves the drum 20 towards the drum 22 and the old sanding belt is removed and/or a new sanding belt is installed. Then, the release lever is operated to move the drum 20 away from drum 22 so that the belt is again under tension. The cylindrical drum 22 is normally a powered drive drum for rotating the belt about its operational path.

Between the drums 22 and 24 is a foot pad 12 having a flat, bottom surface 28 for pressing against the inner surface of the sanding belt 14 so that the outer, rough sanding surface is forced against the surface being sanded. The foot pad 12, as illustrated in FIG. 1, is generally rectangular with upright shoulders 30 and 32 extending transversely across opposite ends thereof. Typically, the shoulders have opposing concave curved surfaces facing each other for securing the foot pad to the base 18 of sander 10 in a conventional manner. The structural components thus described are conventional in the belt sander art and do not, per se, form a part of the invention.

As illustrated in FIG. 2, the prior art sander is particularly suitable for sanding a floor surface 13. The area of the sanding surface of the belt in contact with the floor during operation of the sander is defined as the "sanding footprint" herein. The sanding footprint is equal to the area of the flat, bottom surface 28 of the foot pad 12 which presses the sanding belt against the floor surface during operation of the belt sander. When the belt sander is operated next to a wall 27, a strip A of the floor 13 adjacent the wall is not sanded because the housing 16 and/or the cylindrical drum 20 interferes. This deficiency in the prior art belt sanders requires the operator to sand the strip A by some other means at excessive time and expense.

Figure 3:
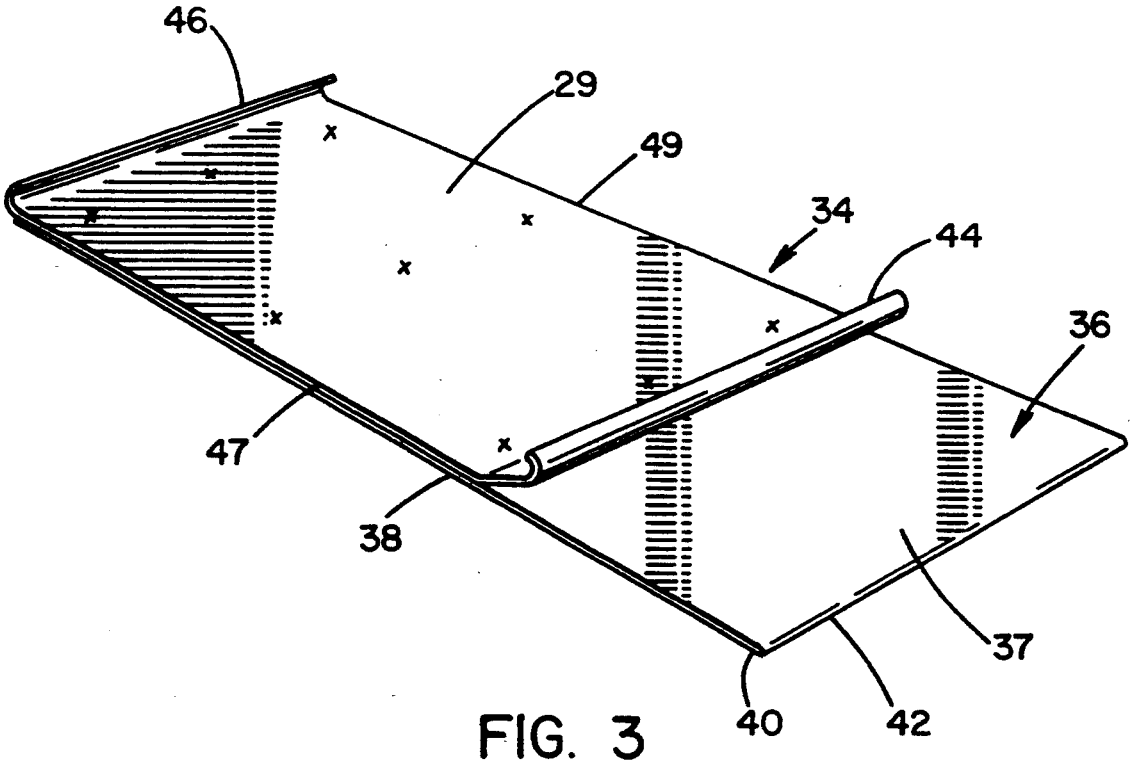
FIG. 3 is a perspective, front elevational view of a first embodiment of a modified foot pad with a foot pad extender in accordance with the present invention.

Referring now to FIG. 3, the first embodiment of the novel foot pad and foot pad extender 34 is illustrated. A foot pad section 29, which can be substantially similar to the foot pad 12 of the prior art, has a foot pad extender 36 attached thereto. The extender 36 is provided for extending the sanding footprint beyond the housing. The extender 36 comprises a flat plate 37 having a first end 38 attached to the foot pad section 29 and a second end 40 projecting at least to and preferably beyond the first end 24 of the sander housing 16. The foot pad extender can be secured to the foot pad by any desired means such as but not limited to welding. Preferably, they are bonded into a unitary structure.

The second end 40 of the flat plate 37 comprises a bearing surface 42 over which the inner surface of the sanding belt rides. The bearing surface 42 is substantially parallel to the first and second cylindrical drums and comprises a rounded or dulled edge to prevent the sanding belt from tearing. In the preferred embodiment, the rounded or dulled edge is semicircular.

As with the prior art configuration of FIG. 1, the foot pad and extender 34 can have two upright shoulders 44 and 46 extending transversely across opposing parallel edges 47 and 49 of the pad. The shoulders are provided for securing the pad to the base 18 of housing 16.

While the present invention is illustrated with shoulders 44 and 46, it is also within the terms of the invention to delete the shoulders. Then, the pad and extender can be secured or bonded to the base 18, which can be a foot pad affixed to the sander, by any desired means such as gluing.

Figure 4:
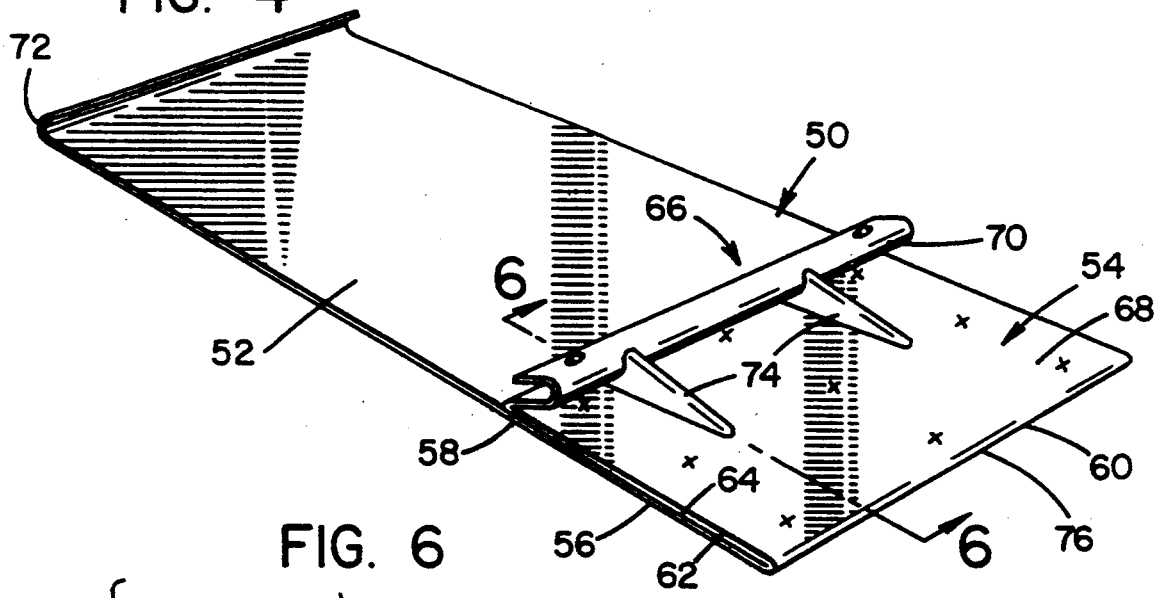
FIG. 4 is a perspective, front elevational view of a second embodiment of a modified foot pad with a foot pad extender in accordance with the present invention.
Figure 5:
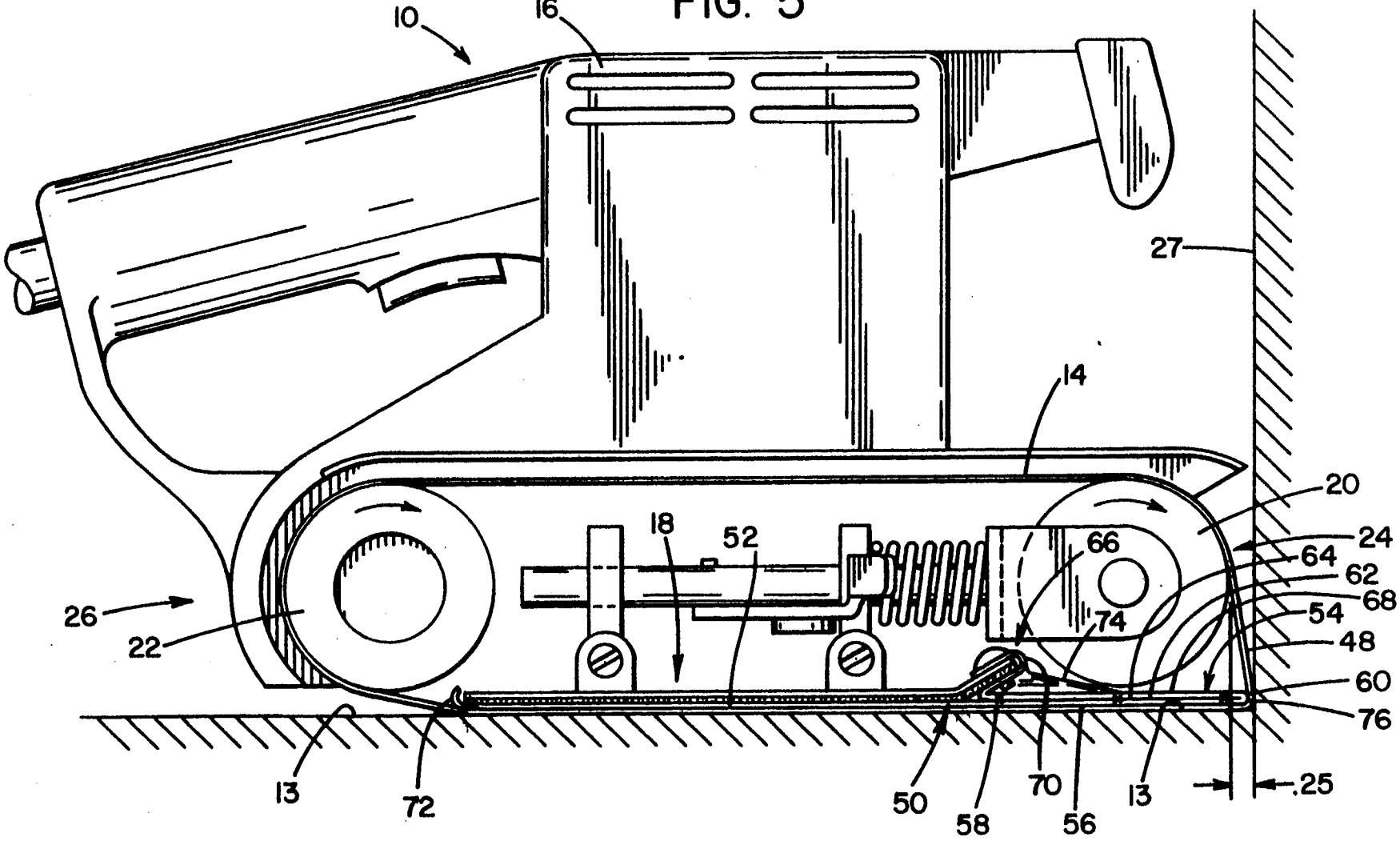
FIG. 5 is a side view of a belt sander with the foot pad and foot pad extender in accordance with the second embodiment of the present invention.

FIG. 4 illustrates a second embodiment of the invention wherein the pad and extender 50 include a foot pad section 52, which corresponds to the foot pad 12 of the prior art. A foot pad extender 54 is integrally formed therewith. The extender 54, as with extender 36 of the embodiment illustrated in FIG. 3, is provided for extending the sanding footprint beyond the housing. The extender 54 comprises a flat plate 56 which extends from the section 52. Plate 56 has a first end 58 integrally attached to the foot pad section 52 and a second end 60. The plate 56 is bent along the end 60 to form a top plate 62 which overlies and is in contact with the upper surface 64 of the plate 56. The free end 66 of the top plate 62 can be folded back to overlie the top surface 68 of plate 62 and the folded again to form an upright shoulder 70. The free end of section 52 also includes an upright shoulder 72 so that the pad and extender 50 can be secured to the base 18 of a sander as illustrated in FIG. 5. The end 60 of the plate is constructed so as to project at least to and preferably beyond the first end 24 of the sander housing 16, as illustrated in FIG. 5. To insure that the foot pad extender 54 is rigid in nature during operation, struts 74 are affixed to the top surface 68 of the plate 62. The struts keep the upright shoulder 70 stiff and in place. The struts can be attached to the plate 62 by any conventional means such as welding or embossment as shown.

As discussed with respect to the embodiment illustrated in FIG. 4, the end 60 of the flat plate 56 comprises a bearing surface 76 which engages the inner surface of the sanding belt 14. The bearing surface 76 is substantially parallel to the axes about which the first and second cylindrical drums rotate and comprise a rounded or dulled edge to prevent the sanding belt from tearing.

Figure 6:
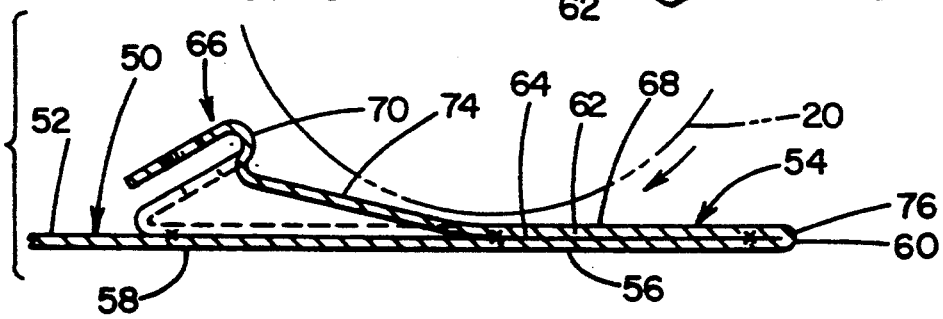
FIG. 6 is a view through line 6—6 of FIG. 4.
Figure 7:
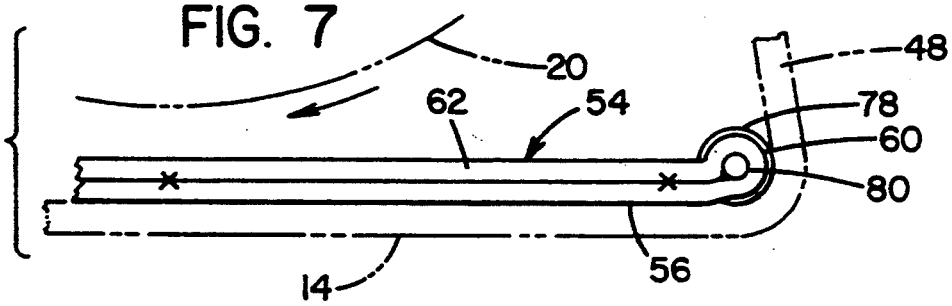
FIG. 7 is a side view of the foot pad extender of FIG. 4 wherein the outer end has been modified by adding a rotatable shaft.

Referring to FIG. 7, there is illustrated a modification of the end 60 of the embodiment illustrated in FIGS. 4–6. A rotatable shaft 78 extending substantially the width of the plate 56 provides a freely rotating surface about which the sanding belt can ride. The ends 80 of the shaft 78 can be secured to the plate 56 where it is bent over along the end 60. A section of the plates 56 and 62 adjacent the end 60 would have to be removed to receive the shaft 78.

In operation, the belt sander, as illustrated in FIG. 5, can be positioned next to a wall so that the entire floor surface up to and contiguous with the wall 27 is sanded. Preferably, the pad extender extends at least 0.25 inch beyond the housing 16 so that the section 48 of belt 14 between the end pad extender and the cylindrical drum 20 does not contact the wall.

The invention has been described with reference to preferred embodiments and it is apparent that many modifications can be incorporated into the designs and configurations of the foot pad extender for a belt sander disclosed herein without departing from the sphere or essence of the invention. It is intended to include all such modifications and alterations as come within the scope of the present invention.

Having thus defined the invention, it is claimed:

1. In a belt sander having a housing with a base, first and second cylindrical drums disposed parallel to each other at first and second opposite ends, respectively, of said base and a foot pad positioned between said cylindrical drums whereby a sanding belt bearing against said foot pad during rotation of the sanding belt defines a sanding footprint, the improvement comprising:

means secured to said foot pad for extending said sanding footprint beyond said housing.

2. The belt sander of claim 1 wherein the means for extending comprises a flat plate having a first end attached to said foot pad and a second end projecting beyond the first end of said housing.

3. The belt sander of claim 2 wherein said second end of the flat plate comprises a bearing surface over which the inner surface of the sanding belt rides, said bearing surface being substantially parallel to the first and second cylindrical drums.

4. The belt sander of claim 3 wherein said bearing surface comprises a rounded edge to prevent the sanding belt from tearing.

5. The belt sander of claim 4 wherein said rounded edge is semicircular.

6. The belt sander as in claim 2 wherein said flat plate and said foot pad are a unitary structure.

7. The belt sander as in claim 2 wherein said foot pad has two upright shoulders extending transversely across opposing ends of the pad for securing the pad to said housing.

8. The belt sander as in claim 2 wherein said pad extends at least 0.25 inch beyond the housing.

9. The belt sander as in claim 7 wherein said unitary structure is substantially rectangular.

10. A foot pad extender adapted for attachment to a foot pad of a belt sander whereby a sanding belt bearing against said foot pad defines a sanding footprint, comprising:

A flat plate having a first end attached to said foot pad and a second end projecting at least to and preferably beyond the end of said belt sander; and means for securing said flat plate to said foot pad for extending the sanding footprint of the belt sander.

11. The foot pad of claim 10 wherein the means for extending comprises a flat plate having a first end attached to said foot pad and a second end adapted to project beyond said housing.

12. The foot pad of claim 11 wherein said second end of the flat plate comprises a bearing surface over which a sanding belt is adapted to ride.

13. The foot pad of claim 12 wherein said bearing surface comprises a rounded edge to prevent the sanding belt from tearing.

14. The foot pad of claim 13 wherein said rounded edge is semicircular.

15. The foot pad of claim 11 wherein said flat plate and said foot pad are a unitary structure.

16. The foot pad of claim 11 further including two upright shoulders extending transversely across opposing ends of the pad being adapted for securing the foot pad to said housing.

17. The foot pad of claim 15 wherein said unitary structure is substantially rectangular.

* * * * *